US009535446B2

(12) United States Patent
Glibbery

(10) Patent No.: US 9,535,446 B2
(45) Date of Patent: Jan. 3, 2017

(54) SYSTEM AND METHOD FOR POWER TRIMMING A BANDGAP CIRCUIT

(75) Inventor: Adam Glibbery, Hants (GB)

(73) Assignee: Analog Devices, Inc., Norwood, MA (US)

( * ) Notice: Subject to any disclaimer, the term of this patent is extended or adjusted under 35 U.S.C. 154(b) by 140 days.

(21) Appl. No.: 13/182,056

(22) Filed: Jul. 13, 2011

(65) Prior Publication Data

US 2013/0015834 A1 Jan. 17, 2013

(51) Int. Cl.

| | |
|---|---|
| ***G05F 3/16*** | (2006.01) |
| ***G05F 3/20*** | (2006.01) |
| ***G05F 1/10*** | (2006.01) |
| ***G05F 3/02*** | (2006.01) |
| ***G05F 3/30*** | (2006.01) |

(52) U.S. Cl.

CPC ..... *G05F 3/30* (2013.01)

(58) Field of Classification Search

CPC ..... G05F 3/02; G05F 3/08; G05F 3/10; G05F 3/16; G05F 3/26; G05F 3/30; G05F 3/262; G05F 3/265; G05F 3/267; G05F 3/46; G05F 3/342; G05F 3/245; G05F 1/468

USPC ..... 323/311–317, 281, 907; 327/538–543, 327/512, 513; 341/120, 121; 324/105, 324/750.03–750.09, 762.01–762.03; 702/85, 99, 107

See application file for complete search history.

(56) References Cited

U.S. PATENT DOCUMENTS

| | | | | |
|---|---|---|---|---|
| 6,501,256 | B1 * | 12/2002 | Jaussi et al. | 323/315 |
| 7,170,274 | B2 * | 1/2007 | Mukherjee et al. | 323/313 |
| 7,224,209 | B2 * | 5/2007 | Hsu | 327/538 |
| 7,782,042 | B2 * | 8/2010 | Fukuzawa | 323/314 |
| 8,228,053 | B2 * | 7/2012 | Stellberger et al. | 323/313 |
| 2002/0033720 | A1 * | 3/2002 | Ikehashi et al. | 327/143 |
| 2010/0123514 | A1 * | 5/2010 | Le et al. | 327/539 |
| 2010/0156519 | A1 * | 6/2010 | Cremonesi et al. | 327/539 |

* cited by examiner

*Primary Examiner* — Timothy J Dole
*Assistant Examiner* — Carlos Rivera-Perez
(74) *Attorney, Agent, or Firm* — Schwegman Lundberg & Woessner, P.A.

(57) ABSTRACT

Techniques to perform bandgap circuit trimming that maximize the operating range and minimize the trimming time at which the bandgap will be accurate. A bandgap circuit output voltage may be trimmed by heating the circuit, supplying increasing input power to the bandgap circuit, and adjusting operational parameters of the bandgap circuit to generate a constant bandgap circuit output voltage. When the bandgap circuit output voltage may remain constant, a constant input power may be applied to the bandgap circuit and its output voltage may be adjusted to a predetermined voltage level.

24 Claims, 6 Drawing Sheets

100

200

300
HEAT BANDGAP CIRCUIT 310
APPLY INCREASING POWER TO PTAT AND CTAT 320
SUM PTAT AND CTAT OUTPUT 330
MEASURE BANDGAP CIRCUIT OUTPUT 340
DOES OUTPUT REMAIN CONSTANT? 350
NO
YES
ADJUST PTAT/ CTAT BALANCE 360
APPLY CONSTANT POWER 370
ADJUST BANDGAP CIRCUIT OUTPUT 380
CONTINUE HEATING 390
MEASURE BANDGAP CIRCUIT OUTPUT 392

400

500

600

SYSTEM AND METHOD FOR POWER TRIMMING A BANDGAP CIRCUIT

BACKGROUND

A bandgap circuit or simply, "bandgap" is an electronic circuit that generates an output voltage that is approximately temperature-invariant. The reference voltage signal may also be termed a precision voltage signal. A bandgap circuit may be part of a larger integrated circuit (IC). In an IC, a bandgap circuit may provide reference voltages for other voltage-sensitive circuits within the chip. A bandgap circuit may be tuned or "trimmed" to generate a precision reference voltage signal for a predetermined operating temperature. Conventional trimming operations occur during IC manufacture and validation processes. Although bandgap circuits may be trimmed to provide a precise reference voltage, traditional trimming techniques are time-consuming, costly, and may only provide a limited temperature range wherein the bandgap's output voltage remains constant.

A trimming technique known as a "temperature trim" may involve heating a chip from a first temperature to a second temperature and adjusting the bandgap's output voltage at each temperature to provide the desired reference voltage. For a limited range of temperature values around the first and second temperature, the bandgap's output will be accurate. However, as the temperature diverges from the first and/or second temperature, the bandgap reference voltage may diverge in a non-linear manner away from the desired reference voltage. In turn, the voltage-sensitive circuits receiving the bandgap reference voltage may malfunction throughout such divergent temperature ranges.

Beyond bandgap reference voltage nonlinearity issues, temperature trimming requires physically heating each of a chip to perform the trim. Such trimming operations require ICs to be loaded into a machine and tested. Once the chip is heated to the desired temperature, then the reference voltage may be trimmed by performing a number of trimming operations. Thus, a temperature trim may require several seconds of time to heat and trim a chip to a desired bandgap reference voltage. Since trimming operations are prolonged, temperature trimming limits the number of ICs that can be manufactured per unit time. As the number of chips that must be trimmed increases, the time required to perform a temperature trim on the lot of chips may scale in kind.

Accordingly, there is a need in the art for trimming a bandgap circuit that provides an increased temperature-invariance range for a bandgap reference voltage within a minimized trimming time.

DETAILED DESCRIPTION

Embodiments of the present invention provide techniques to perform bandgap circuit trimming operations that maximize the operating range and minimize the trimming time at which the bandgap will be accurate. A bandgap circuit output voltage may be trimmed by heating the circuit, supplying increasing input power to the circuit, and adjusting operational parameters of the bandgap circuit to generate a constant bandgap circuit output voltage. When the bandgap output voltage may remain constant, a constant input power may be applied to the bandgap circuit and its output voltage may be adjusted to a predetermined level.

Figure 1:
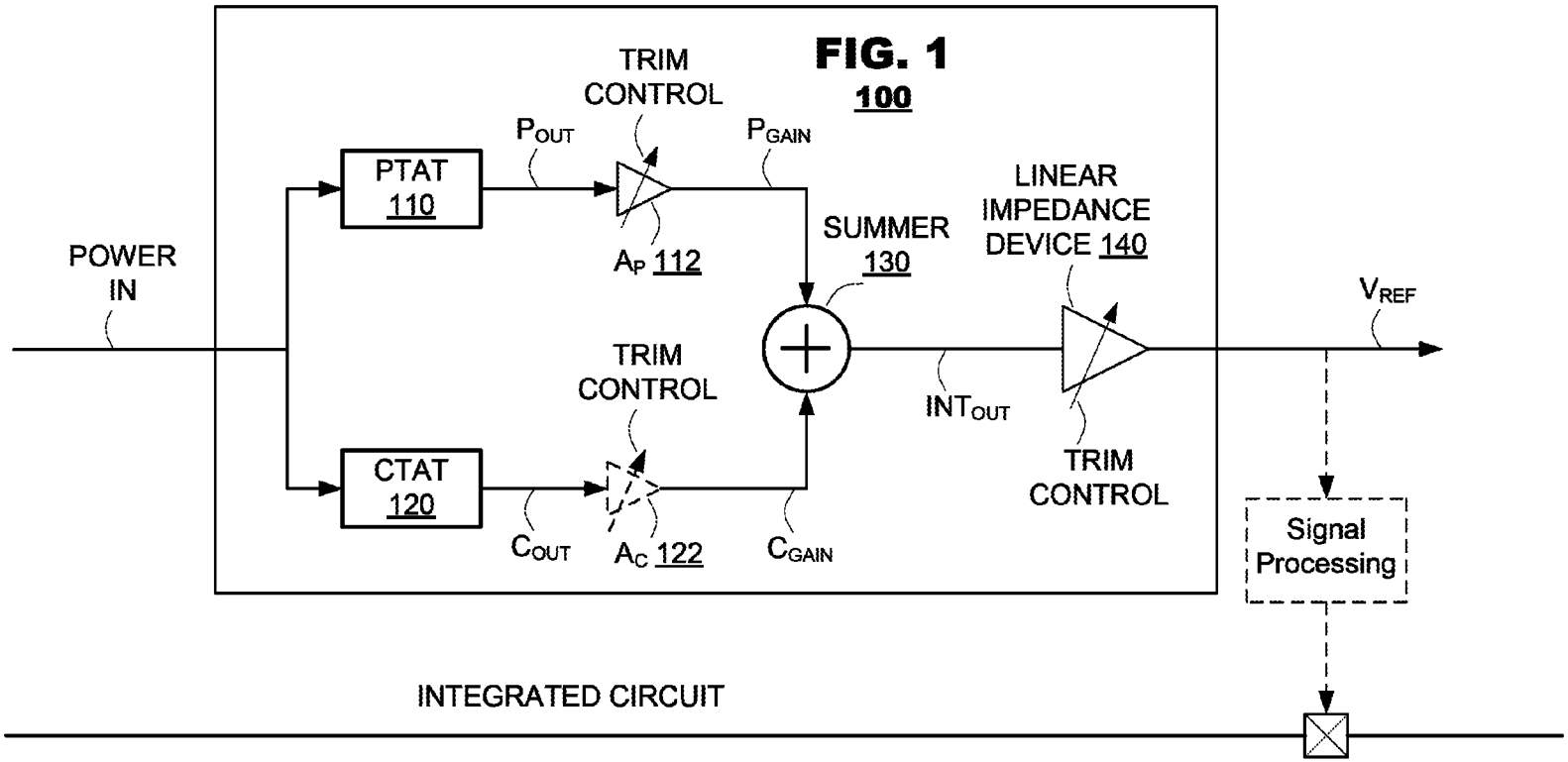
FIG. 1 illustrates a block diagram of a bandgap circuit 100 according to an embodiment of the present invention.

FIG. 1 illustrates a block diagram of a bandgap circuit 100 according to an embodiment of the present invention. The bandgap circuit may reside in an integrated circuit. As illustrated in FIG. 1, an embodiment of a bandgap circuit 100 may include a proportional-to-absolute-temperature (PTAT) source 110, a PTAT gain control ($A_P$) 112 coupled to the output of the PTAT source 110, a complementary-to-absolute-temperature (CTAT) source 120, a summer 130, and an adjustable gain linear impedance device 140. The sources 110, 120 may be either voltage sources or current sources as desired.

The PTAT source 110 may generate an output signal $P_{OUT}$ that may increase as the temperature of the PTAT source 110 increases. Conversely, the CTAT source 120 may generate an output signal $C_{OUT}$ that may decreases as the temperature of the CTAT source 120 increases.

Figure 2:
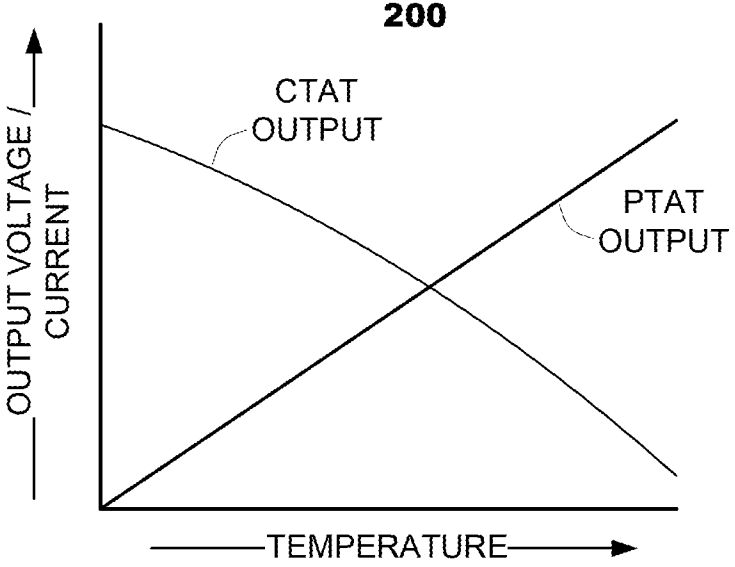
FIG. 2 illustrates a graph 200 representing voltage and temperature characteristics of a bandgap CTAT and PTAT source according to an embodiment of the present invention.

FIG. 2 illustrates a graph 200 representing temperature characteristics of a bandgap CTAT and PTAT source according to an embodiment of the present invention. As illustrated in FIG. 2, each of a CTAT and PTAT source may generate an output voltage or current signal that relates to an increase in temperature of the bandgap circuit. For example, a PTAT source may generate an output voltage or current signal that may increase in proportion to an increase in the bandgap circuit temperature. Conversely, a CTAT source may generate an output voltage or current signal that may be the complement of an increase in the bandgap circuit temperature. Ideally, the contribution of the PTAT and CTAT sources may be adjusted to provide a bandgap output signal that may remain constant as the temperature of the bandgap may increase.

In an embodiment of the bandgap circuit 100, a CTAT gain control ($A_C$) 122 may be coupled to the CTAT source 120 output. Typically, adjustment of only two of the three gain elements of FIG. 1 (i.e., $A_P$ 112, or $A_C$ 122, and linear impedance device 140) are needed to balance the PTAT and CTAT contributions and adjust the bandgap reference voltage output signal to a desired level. In one embodiment, this may include adjusting the PTAT gain $A_P$ 112 to generate a PTAT gain adjusted output signal $P_{GAIN}$ and adjusting the linear impedance device 140 gain. In another embodiment, this may include adjusting the CTAT gain $A_C$ 122 to generate a CTAT gain adjusted output signal $C_{GAIN}$ and adjusting the linear impedance device 140 gain.

In an embodiment, the linear impedance device 140 of FIG. 1 and at least one of the gain controls 112 or 122 may be adjusted by trim control settings, which may be developed during trimming operations. The trim control settings may be stored in configuration registers on the integrated circuit (not shown).

The PTAT and CTAT output signals may be summed together in the summer 130 to generate an intermediate output voltage or current signal $INT_{OUT}$ representing a sum of the signals. The intermediate output voltage or current signal $INT_{OUT}$ may be then supplied to the linear impedance device 140 which may generate an output voltage signal $V_{REF}$. The magnitude of output voltage signal $V_{REF}$ may be adjusted by trimming the gain of the linear impedance output device 140.

During a power trim operation, power to the PTAT and CTAT 110, 120 may be increased as the bandgap circuit may be heated. The bandgap circuit heating may be implemented by heating the bandgap circuit with an external heating device or by heating the circuit with internal devices. As the power may be increased, either one or both of the PTAT gain $A_P$ or CTAT gain $A_C$ 112, 122 may be trimmed such that the summing the output signals in the summer 130 may generate a constant intermediate output voltage or current signal $INT_{OUT}$. As a result of the power trimming operation, the intermediate voltage or current output signal $INT_{OUT}$ may remain constant even as the power to the PTAT and CTAT may continue to increase. When the intermediate output voltage or current signal $INT_{OUT}$ may remain at a constant level, the input power may be applied at a constant level and the output gain of the linear impedance device 140 may be trimmed such that the bandgap reference voltage output signal $V_{REF}$ may be at a desired output voltage level. After the power trim, the bandgap reference voltage output signal $V_{REF}$ may be verified to remain constant across a desired temperature range.

In an embodiment, the bandgap reference voltage signal $V_{REF}$ may be coupled to a pin of an IC chip. During a power trim operation, the $V_{REF}$ signal may be measured at the IC pin. In another embodiment, the bandgap reference voltage signal $V_{REF}$ may pass through subsequent signal processing circuitry before being coupled to a pin of an IC chip. During a power trim operation, compensation for the induced contributions of the subsequent signal processing circuitry may be calculated in order to determine a true measurement of the $V_{REF}$ signal.

Because the bandgap circuit 100 may include an adjustable gain linear impedance device 140, the bandgap reference voltage output signal $V_{REF}$ may be trimmed with a power trimming operation to achieve a desired $V_{REF}$ output voltage independent of the temperature of the bandgap circuit 100. Even as the bandgap circuit 100 may continue to be heated to verify operation of the bandgap circuit 100 across a desired temperature range, no further bandgap trimming may be necessary. In this manner, the bandgap circuit 100 may generate reference voltage output signal $V_{REF}$ that may be more constant and linearly predictable across a range of temperatures as opposed to merely trimming a bandgap at a first and second temperature. Similarly, the time to perform bandgap circuit 100 trimming may be minimized by a factor determinate upon increasing the power to the PTAT and CTAT and adjusting the respective bandgap circuit 100 gains as opposed to waiting for the bandgap circuit 100 to achieve a first and second temperature and then performing a trimming operation.

Figure 3:
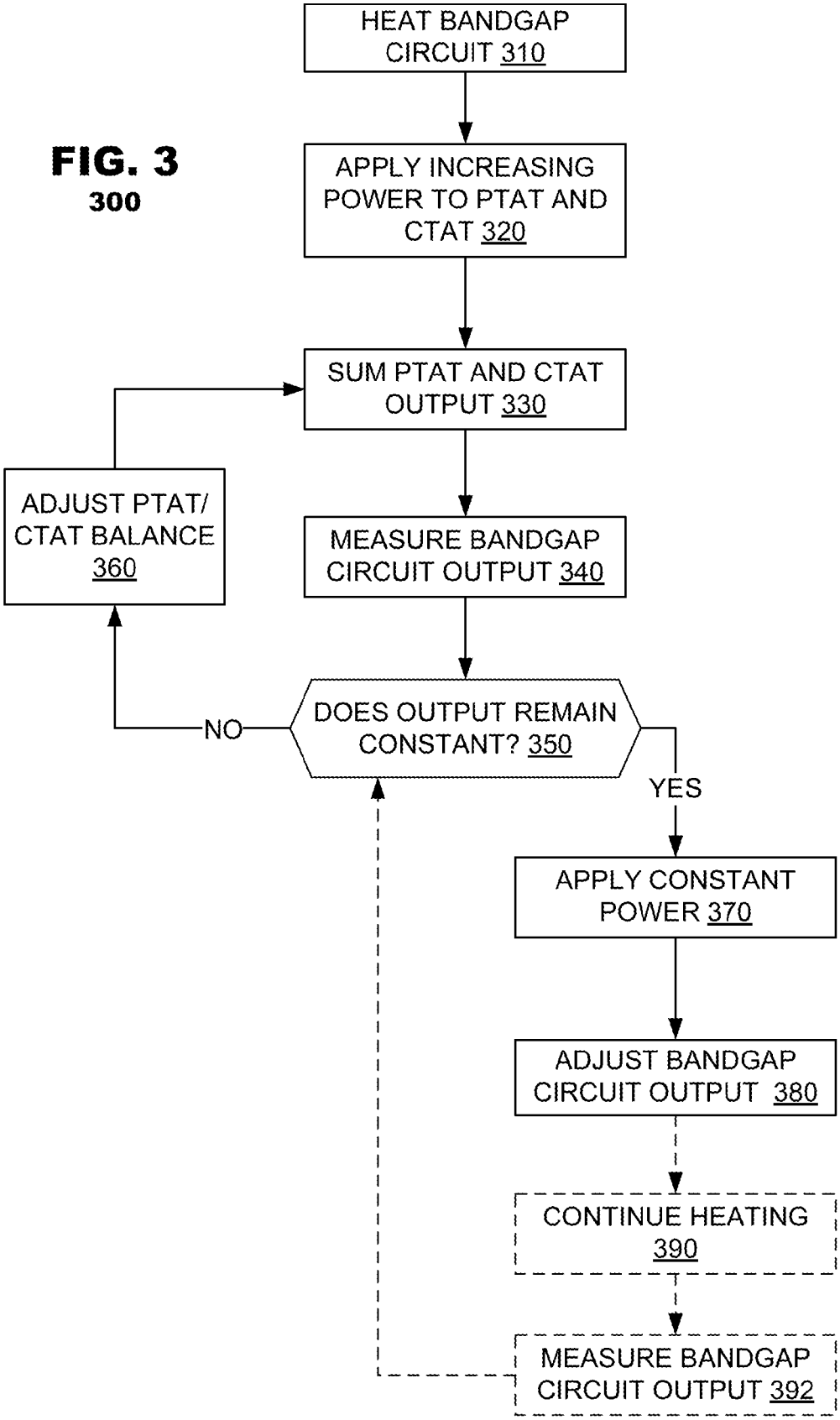
FIG. 3 illustrates a method 300 for power trimming a bandgap circuit to a desired bandgap output reference voltage according to an embodiment of the present invention.

FIG. 3 illustrates a method 300 for power trimming a bandgap circuit to a desired bandgap output reference voltage according to an embodiment of the present invention. As illustrated in block 310, power trimming a bandgap circuit may include heating a bandgap circuit. As the bandgap circuit may be heated, an input power having a predetermined power profile may be injected into a PTAT and CTAT source wherein each may generate a voltage or current output signal (block 320). Each of the PTAT and CTAT output signals may then be summed together to generate an output signal representing the output of the bandgap circuit (block 330). The method may then measure the output of the bandgap circuit (block 340). The method may check the measurement to determine if the output may remain constant with increasing input power (block 350). If the output does not remain constant, the method may adjust gain to balance contribution of the PTAT and CTAT sources (block 360). If the output does remain constant, the method may apply a constant input power to the bandgap circuit (block 370) and adjust the bandgap circuit output voltage to a desired voltage level (block 380).

In an embodiment, the method may further heat the bandgap circuit after adjusting the bandgap circuit to a desired voltage level (block 390). As the method may further heat the bandgap circuit, the output may again be measured (block 392). The method may again check the measurement to determine if the bandgap circuit output voltage may remain constant with increasing temperature (return to block 350).

Figure 4:
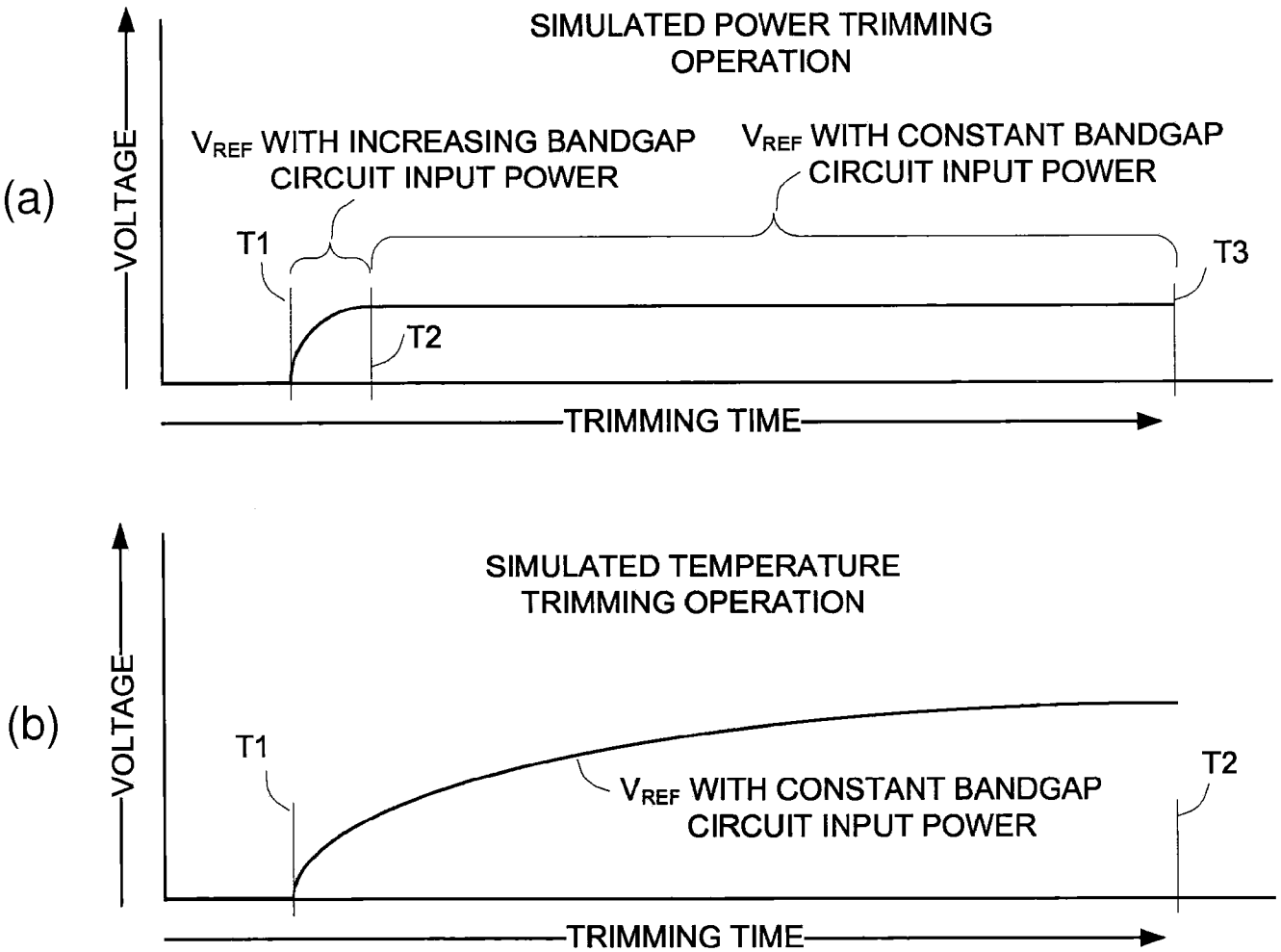
FIG. 4 illustrates simulation graphs 400 representing simulated trimming times for bandgap circuit power and temperature trimming operations.

FIG. 4 illustrates simulation graphs 400 representing simulated trimming times for bandgap circuit power and temperature trimming operations. FIG. 4(*a*) illustrates a simulated trimming time and corresponding bandgap circuit output voltage $V_{REF}$ for a simulated power trimming operation. When power trimming a bandgap circuit, the bandgap circuit input power (not shown) may be increased until the bandgap circuit output $V_{REF}$ may be trimmed to become constant. The power trimming operation may begin at time T1 where the bandgap circuit may be at room temperature. Next, the bandgap circuit may begin to be heated by an external device and the input power to the circuit may begin to be increased.

As the power may be increased, the bandgap circuit may be trimmed to produce a constant bandgap circuit output voltage $V_{REF}$. Time T2 illustrates a point at which the bandgap circuit output voltage $V_{REF}$ may be trimmed to become constant. At time T2, the input power may stop being increased and the bandgap circuit output voltage $V_{REF}$ may be adjusted to a desired voltage level (e.g., blocks 370, 380 of FIG. 3). The chip may continue to be heated to time T3 for further verification that the bandgap circuit output voltage $V_{REF}$ may remain constant, however, no further bandgap circuit trimming ideally would be required at the desired temperature.

FIG. 4(*b*) illustrates a simulated trimming time and corresponding bandgap circuit output voltage $V_{REF}$ for a simulated temperature trimming operation. As discussed, when temperature trimming a bandgap circuit, the bandgap circuit input power (not shown) is held constant. The temperature trimming operation may begin by performing a first temperature trim on the bandgap circuit at time T1 where the bandgap circuit may be at room temperature. Next, the bandgap circuit must be heated to a desired temperature and a second temperature trim is performed at time T2. As illustrated, the bandgap circuit output $V_{REF}$ does not become constant until the circuit is heated and trimmed at the second trim time T2.

As illustrated, the trimming time T2 of FIG. 4(*a*) required to complete a bandgap circuit power trimming operation may be much less than the trimming time T2 of FIG. 4(*b*) required to complete a similarly situated temperature trimming operation. The bandgap circuit power trimming time may be limited primarily by the rate of increasing input power to the bandgap circuit, whereas, the temperature trimming time is limited by the time required to physically heat the bandgap circuit to the desired temperature.

Figure 5:
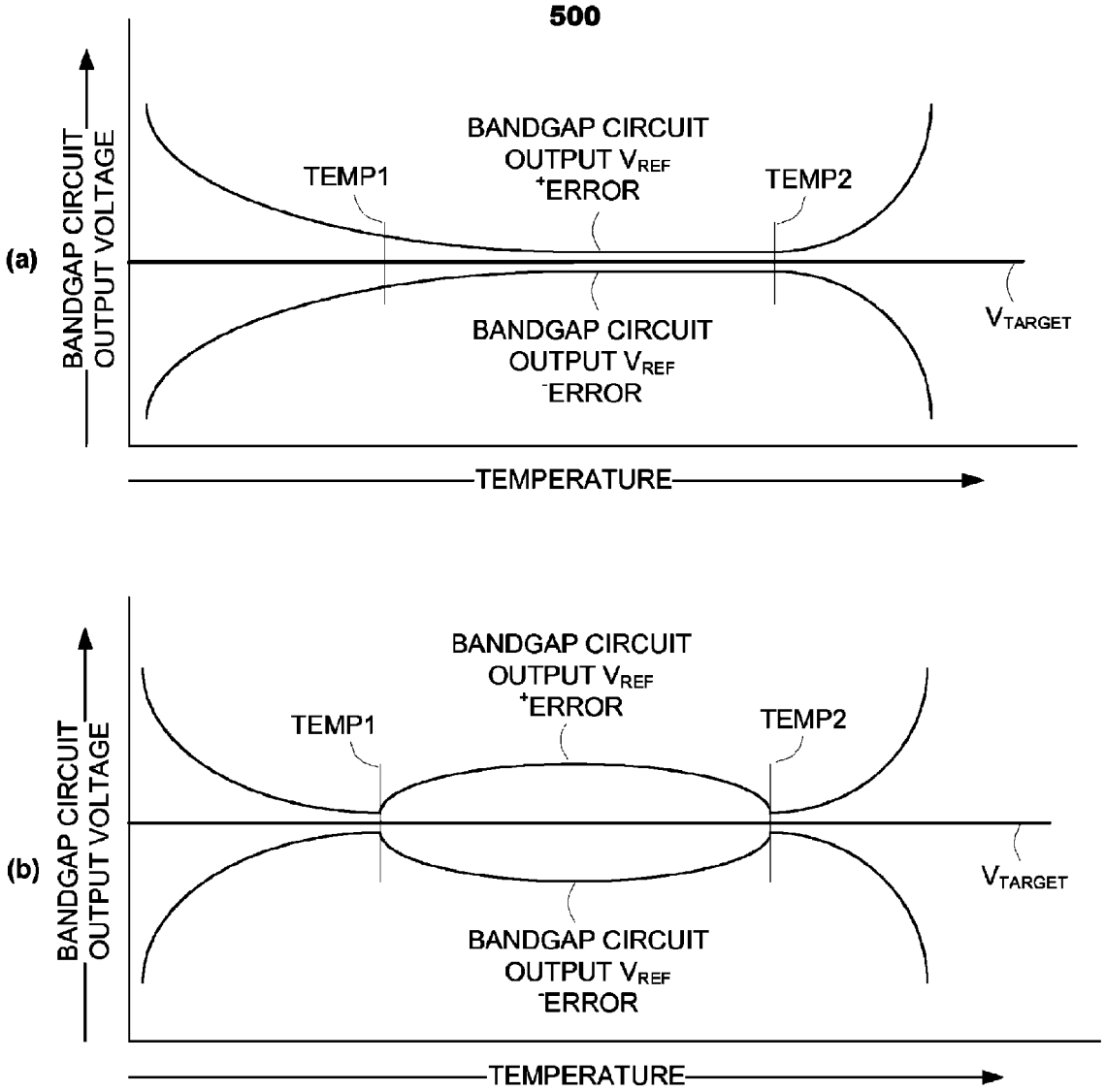
FIG. 5 illustrates simulation graphs 500 representing a simulated bandgap circuit reference output voltage signal distribution according to an embodiment of the present invention as compared to a bandgap circuit reference output voltage signal distribution according to temperature trimming a bandgap circuit.

FIG. 5 illustrates simulation graphs 500 representing a simulated bandgap circuit reference output voltage signal distribution according to an embodiment of the present invention as compared to a bandgap circuit reference output voltage signal distribution according to temperature trimming a bandgap circuit.

FIG. 5(*a*) illustrates a simulated distribution of a bandgap circuit reference voltage output signal $V_{REF}$ that may be achieved by a power trimming operation performed on a bandgap circuit according to an embodiment of the present invention. The bandgap circuit voltage output signal $V_{REF}$ distribution may be illustrated with positive error (+ERROR) and negative error (−ERROR) in relation to a desired target reference output voltage $V_{TARGET}$. Also illustrated, are two temperature reference points: room temperature, TEMP1 and a final trim temperature TEMP2. A power trimming method according to an embodiment of the present invention as described in FIG. 3 may be performed on the bandgap. In response to a power trimming operation, the bandgap reference voltage output signal may converge toward the desired reference voltage $V_{TARGET}$. The bandgap circuit reference output voltage signal $V_{REF}$ may converge on the target voltage $V_{TARGET}$ in a predictable manner even though the temperature of the bandgap may continue to increase.

In contrast, FIG. 5(*b*) illustrates a simulated distribution of a bandgap circuit reference voltage output signal $V_{REF}$ using a temperature trimming operation. The bandgap circuit voltage output signal $V_{REF}$ distribution is illustrated with positive error (+ERROR) and negative error (−ERROR) in relation to a desired target reference output voltage $V_{TARGET}$. Here, the bandgap circuit may be trimmed at room temperature TEMP1, subsequently heated, and then trimmed again at a final trim temperature TEMP2. As illustrated, the bandgap reference voltage output signal $V_{REF}$ may converge on the target voltage $V_{TARGET}$ at room temperature TEMP1 and the final temperature TEMP2 of the temperature trim. However, it may diverge in an unpredictable exponential manner away from the target voltage $V_{TARGET}$ for the range of temperatures between the first and second temperature TEMP1 and TEMP2.

Figure 6:
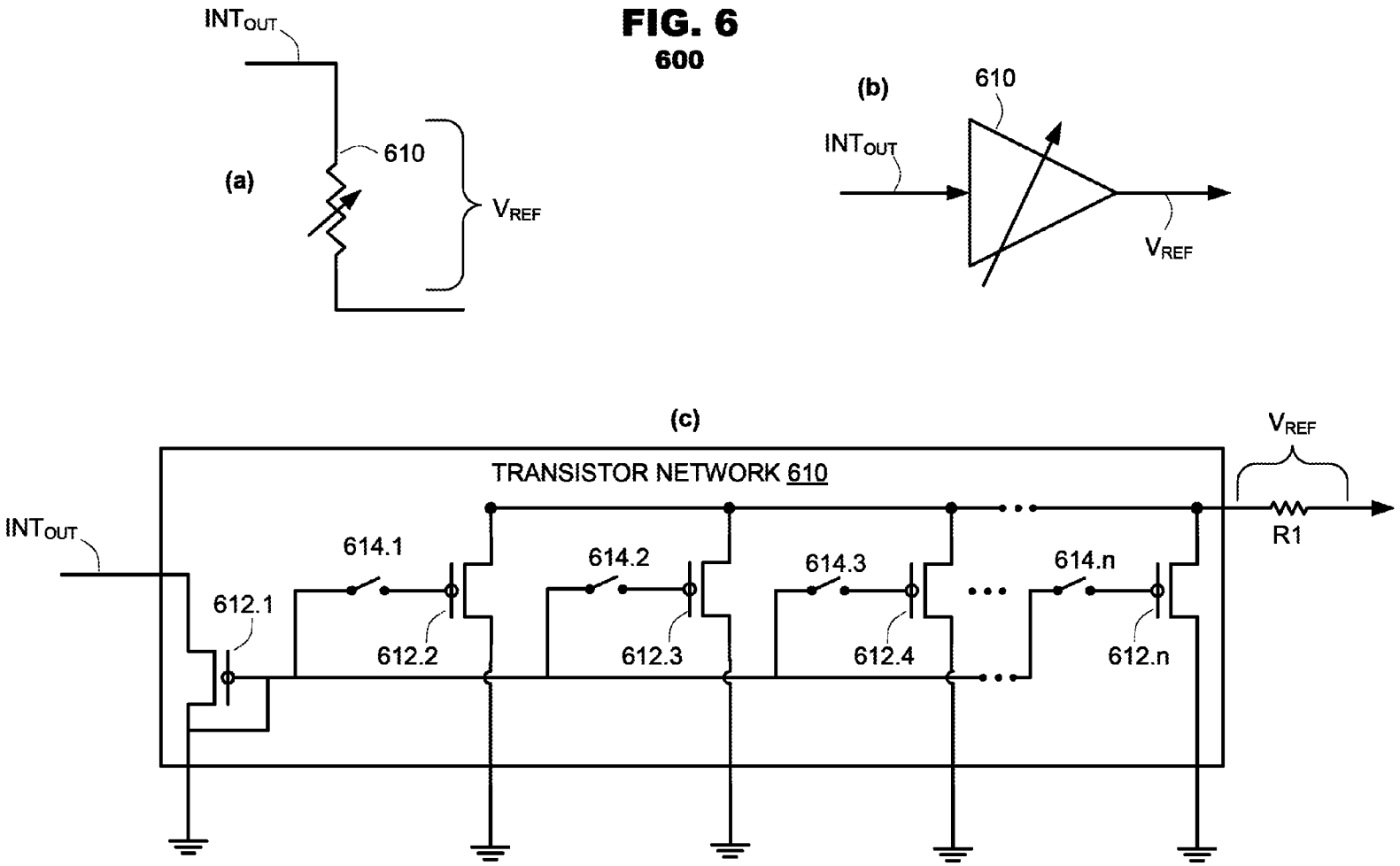
FIG. 6 illustrates adjustable gain linear impedance device configurations 600 according to an embodiment of the present invention.

FIG. 6 illustrates adjustable gain linear impedance device configurations 600 according to an embodiment of the present invention. As illustrated in FIG. 6(*a*) an adjustable gain linear impedance device may be implemented as a variable resistor 610 having a programmable resistance. During a bandgap circuit power trimming operation, an intermediate output current $INT_{OUT}$ may be supplied to the variable resistor 610. In turn, the resistance of the variable resistor 610 may be trimmed to produce a desired bandgap circuit reference voltage output signal $V_{REF}$. The bandgap circuit reference voltage output signal $V_{REF}$ may be the produced by the voltage drop across the variable resistor 610.

As illustrated in FIG. 6(*b*), an adjustable gain linear impedance device may be implemented as a linear operational amplifier (op-amp) 610 having a programmable gain control. During a power trimming operation, an intermediate output voltage $INT_{OUT}$ may be supplied to the op-amp 610. In turn, the op-amp gain may be trimmed to produce a desired bandgap reference voltage output signal $V_{REF}$.

As illustrated in FIG. 6(*c*), an adjustable gain linear impedance device may be implemented as a selectable transistor network 610 having transistors 612.1-612.*n* drain-coupled via successive switches 614.1-614.*n*. Each of a transistor 612.1-612.*n* may be weighted to provide for a scalable current. During a power trimming operation, an intermediate output current $INT_{OUT}$ may be supplied to transistor 612.1. Each of a switch 614.1-614.*n* may be set on or off by a trim control setting to select a combination of transistors 612.1-612.*n* that may produce a desired current. The bandgap reference voltage output signal $V_{REF}$ may be produced by driving a desired current through a resistor R1.

Several embodiments of the present invention are specifically illustrated and described herein. However, it will be appreciated that modifications and variations of the present invention are covered by the above teachings and within the purview of the appended claims without departing from the spirit and intended scope of the invention.

I claim:

1. A method for adjusting a bandgap circuit output voltage, comprising: in a first stage, while temperature of the bandgap circuit is increased using a thermal energy source external to the bandgap circuit: (1) applying the thermal energy to the bandgap circuit to cause increasing temperature; (2) measuring the bandgap circuit output voltage; and (3) if the bandgap circuit output voltage does not remain constant, adjusting, while the temperature of the bandgap circuit is continuously increasing, a temperature dependent source of the bandgap circuit to generate a constant output voltage; in a second stage after the bandgap circuit output voltage remains constant: (1) applying a constant thermal input power to the bandgap circuit; and (2) adjusting gain of a linear impedance device of the bandgap circuit to generate an output voltage at a predetermined voltage level.

2. The method of claim 1, the applying of the thermal energy to the bandgap circuit to cause increasing temperature further comprising: applying input power to a bandgap circuit proportional-to-absolute-temperature (PTAT) source to generate a PTAT source output, applying input power to a bandgap circuit complementary-to-absolute-temperature (CTAT) source to generate a CTAT source output, and summing the PTAT source output and the CTAT source output to generate the bandgap circuit output voltage.

3. The method of claim 2, the measuring the bandgap circuit output voltage further comprising:

if the bandgap circuit output voltage does not remain constant, adjusting the PTAT source to generate the bandgap circuit constant output voltage.

4. The method of claim 2, the measuring the bandgap circuit output voltage further comprising:

if the bandgap circuit output voltage does not remain constant, adjusting the CTAT source to generate the bandgap circuit constant output voltage.

5. The method of claim 1, the applying of the thermal energy to the bandgap circuit to cause increasing temperature further comprising: applying input power to a bandgap circuit proportional-to-absolute-temperature (PTAT) source to generate a PTAT source output, applying input power to a bandgap circuit complementary-to-absolute-temperature (CTAT) source to generate a CTAT source output, summing the PTAT source output and the CTAT source output to generate a bandgap circuit intermediate output, applying the bandgap circuit intermediate output to the bandgap circuit linear impedance device having the adjustable gain to generate the bandgap circuit output voltage.

6. The method of claim 5, the measuring the bandgap circuit output voltage further comprising:

if the bandgap circuit output voltage does not remain constant, adjusting the PTAT source to generate the bandgap circuit constant output voltage.

7. The method of claim 5, the measuring the bandgap circuit output voltage further comprising:

if the bandgap circuit output voltage does not remain constant, adjusting the CTAT source to generate the bandgap circuit constant output voltage.

8. The method of claim 5, the measuring the bandgap circuit output voltage further comprising:

in the second stage after the bandgap circuit output voltage remains constant:

applying the constant thermal input power to the bandgap circuit; and adjusting the gain of the linear impedance device to generate a bandgap circuit output voltage at a predetermined voltage level.

9. The method of claim 1, wherein adjusting the temperature dependent source of the bandgap circuit to generate the constant output voltage includes adjusting an amplifier in at least one of a proportional-to-absolute-temperature (PTAT) circuit branch and a complementary-to-absolute-temperature (CTAT) circuit branch of the bandgap circuit.

10. A method for adjusting a bandgap circuit output voltage, comprising: in a first stage, while heating the bandgap circuit by a heating source external to the bandgap circuit: (1) applying thermal energy to the bandgap circuit to cause an increasing temperature of the bandgap circuit; (2) measuring the bandgap circuit output voltage; and (3) if the bandgap circuit output voltage does not remain constant, adjusting, while the temperature of the bandgap circuit is continuously increasing, a proportional-to-absolute-temperature (PTAT) source or a complementary-to-absolute-temperature (CTAT) source of the bandgap circuit to generate a constant output voltage; in the second stage after the bandgap circuit output voltage remains constant: (1) applying a constant thermal input power to the bandgap circuit; and (2) adjusting gain of a linear impedance device of the bandgap circuit to generate an output voltage at a predetermined voltage level.

11. The method of claim 10, the applying of the thermal energy to the bandgap circuit to cause the increasing temperature of the bandgap circuit further comprising: applying input power to a bandgap circuit proportional-to-absolute-temperature (PTAT) source to generate a PTAT source output, applying input power to a bandgap circuit complementary-to-absolute-temperature (CTAT) source to generate a CTAT source output, and summing the PTAT source output and the CTAT source output to generate the bandgap circuit output voltage.

12. The method of claim 11, the measuring the bandgap circuit output voltage further comprising:

if the bandgap circuit output voltage does not remain constant, adjusting the PTAT source to generate the bandgap circuit constant output voltage.

13. The method of claim 11, the measuring the bandgap circuit output voltage further comprising:

if the bandgap circuit output voltage does not remain constant, adjusting the CTAT source to generate the bandgap circuit constant output voltage.

14. The method of claim 10, the applying of the thermal energy to the bandgap circuit to cause the increasing temperature further comprising: applying input power to a bandgap circuit proportional-to-absolute-temperature (PTAT) source to generate a PTAT source output, applying input power to a bandgap circuit complementary-to-absolute-temperature (CTAT) source to generate a CTAT source output, summing the PTAT source output and the CTAT source output to generate a bandgap circuit intermediate output, applying the bandgap circuit intermediate output to the bandgap circuit linear impedance device having the adjustable gain to generate the bandgap circuit output voltage.

15. The method of claim 14, the measuring the bandgap circuit output voltage further comprising:

if the bandgap circuit output voltage does not remain constant, adjusting the PTAT source to generate the bandgap circuit constant output voltage.

16. The method of claim 14, the measuring the bandgap circuit output voltage further comprising:

if the bandgap circuit output voltage does not remain constant, adjusting the CTAT source to generate the bandgap circuit constant output voltage.

17. The method of claim 14, the measuring the bandgap circuit output voltage further comprising: in the second stage after the bandgap circuit output voltage remains constant: applying the constant thermal input power to the bandgap circuit; and adjusting the gain of the linear impedance device to generate the bandgap circuit output voltage at a predetermined voltage level.

18. The method of claim 10, wherein adjusting the PTAT source or the CTAT source of the bandgap circuit to generate the constant output voltage includes adjusting an amplifier in at least one of a proportional-to-absolute-temperature (PTAT) circuit branch and a complementary-to-absolute-temperature (CTAT) circuit branch of the bandgap circuit.

19. An apparatus for adjusting a bandgap circuit output voltage, comprising: means for applying, while a temperature of the bandgap circuit is increasing, thermal energy to the bandgap circuit to cause the increasing temperature; means for measuring, while the temperature of the bandgap circuit is increasing, the bandgap circuit output voltage; and means for adjusting, while the temperature of the bandgap circuit is continuously increasing, a temperature dependent source of the bandgap circuit to generate a constant output voltage, if the bandgap circuit output voltage does not remain constant; means for applying, after the bandgap circuit output voltage remains constant, a constant thermal input power to the bandgap circuit; and means for adjusting, after the bandgap circuit output voltage remains constant, gain of a linear impedance device of the bandgap circuit to generate an output voltage at a predetermined voltage level.

20. The apparatus of claim 19, the means for applying the thermal energy to the bandgap circuit to cause the increasing temperature further comprising: means for applying input power to a bandgap circuit proportional-to-absolute-temperature (PTAT) source to generate a PTAT source output, means for applying input power to a bandgap circuit complementary-to-absolute-temperature (CTAT) source to generate a CTAT source output, and means for summing the PTAT source output and the CTAT source output to generate the bandgap circuit output voltage.

21. The apparatus of claim 20, the means for measuring the bandgap circuit output voltage further comprising:

means for adjusting, if the bandgap circuit output voltage does not remain constant, the PTAT source to generate the bandgap circuit constant output voltage.

22. The apparatus of claim 20, the means for measuring the bandgap circuit output voltage further comprising:

means for adjusting, if the bandgap circuit output voltage does not remain constant, the CTAT source to generate the bandgap circuit constant output voltage.

23. The apparatus of claim 19, the means for applying the thermal energy to the bandgap circuit to cause the increasing temperature further comprising: means for applying input power to a bandgap circuit proportional-to-absolute- temperature (PTAT) source to generate a PTAT source output, means for applying input power to a bandgap circuit complementary-to-absolute-temperature (CTAT) source to generate a CTAT source output, means for summing the PTAT source output and the CTAT source output to generate a bandgap circuit intermediate output, and means for applying the bandgap circuit intermediate output to the bandgap circuit linear impedance device having the adjustable gain to generate the bandgap circuit output voltage.

24. The apparatus of claim 23, the means for measuring the bandgap circuit output voltage further comprising:

means for adjusting, if the bandgap circuit output voltage does not remain constant, the PTAT source to generate the bandgap circuit constant output voltage.

* * * * *